US005930060A

United States Patent [19]

Shih

[11] Patent Number: 5,930,060

[45] Date of Patent: Jul. 27, 1999

[54] MIRROR DEVICE HAVING A CONTACT SWITCH

[76] Inventor: Sen Tien Shih, 7F-1, No. 170, Sec. 1, San Min Rd., Taichung, Taiwan

[21] Appl. No.: 09/072,221

[22] Filed: May 4, 1998

[51] Int. Cl.[6] ..... G02B 7/182; F21V 33/00

[52] U.S. Cl. ..... 359/872; 359/881; 362/135; 362/136; 362/142; 362/144

[58] Field of Search ..... 359/839, 871, 359/872, 881; 362/135, 136, 137, 138, 139, 140, 141, 142, 143, 144, 494

[56] References Cited

U.S. PATENT DOCUMENTS

| | | | |
|---|---|---|---|
| 1,315,457 | 9/1919 | Benedict | 362/135 |
| 1,368,340 | 2/1921 | Jarvis | 362/142 |
| 1,689,471 | 10/1928 | Andrusis | 359/839 |
| 1,761,393 | 6/1930 | Hoegger | 362/141 |
| 2,200,114 | 5/1940 | Konikoff | 362/144 |
| 2,267,132 | 12/1941 | Pavenick | 362/144 |
| 3,217,154 | 11/1965 | Owen | 362/136 |
| 3,476,927 | 11/1969 | Rothman | 362/140 |
| 4,507,716 | 3/1985 | Benedict, Jr. . | |
| 4,751,625 | 6/1988 | Lin . | |
| 5,223,814 | 6/1993 | Suman . | |

FOREIGN PATENT DOCUMENTS

| | | | |
|---|---|---|---|
| 551823 | 4/1923 | France | 362/144 |

*Primary Examiner*—Ricky D. Shafer

[57] ABSTRACT

A mirror device includes a mirror attached to a frame which is pivotally coupled to a support at a pivot shaft. A cover is secured to the frame and made of electric conductive material. A conductive fastener is secured to the cover. One or more light bulbs are disposed in the cover and coupled to a contact switch which is coupled to the conductive fastener for coupling the light bulb to the cover and for allowing the contact switch to be actuated via the cover. A bracket is secured to the cover for supporting the light bulbs.

2 Claims, 2 Drawing Sheets

MIRROR DEVICE HAVING A CONTACT SWITCH

BACKGROUND OF THE INVENTION

1. Field of the Invention

The present invention relates to a mirror, and more particularly to a mirror device having a contact switch.

2. Description of the Prior Art

Typical mirror devices have no lights provided therein. A separate light device is required to be provided for lighting the mirror device.

The present invention has arisen to mitigate and/or obviate the afore-described disadvantages of the conventional mirror devices.

SUMMARY OF THE INVENTION

The primary objective of the present invention is to provide a mirror device which includes a contact switch disposed therein.

In accordance with one aspect of the invention, there is provided a mirror device comprising a frame, a mirror attached to the frame, a cover secured to the frame and made of electric conductive material, a conductive fastener secured to the cover, at least one light bulb, and a contact switch coupled between the light bulb and the conductive fastener for coupling the light bulb to the cover and for allowing the contact switch to be actuated via the cover.

A bracket is further provided and secured to the cover, the light bulb is secured to the bracket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
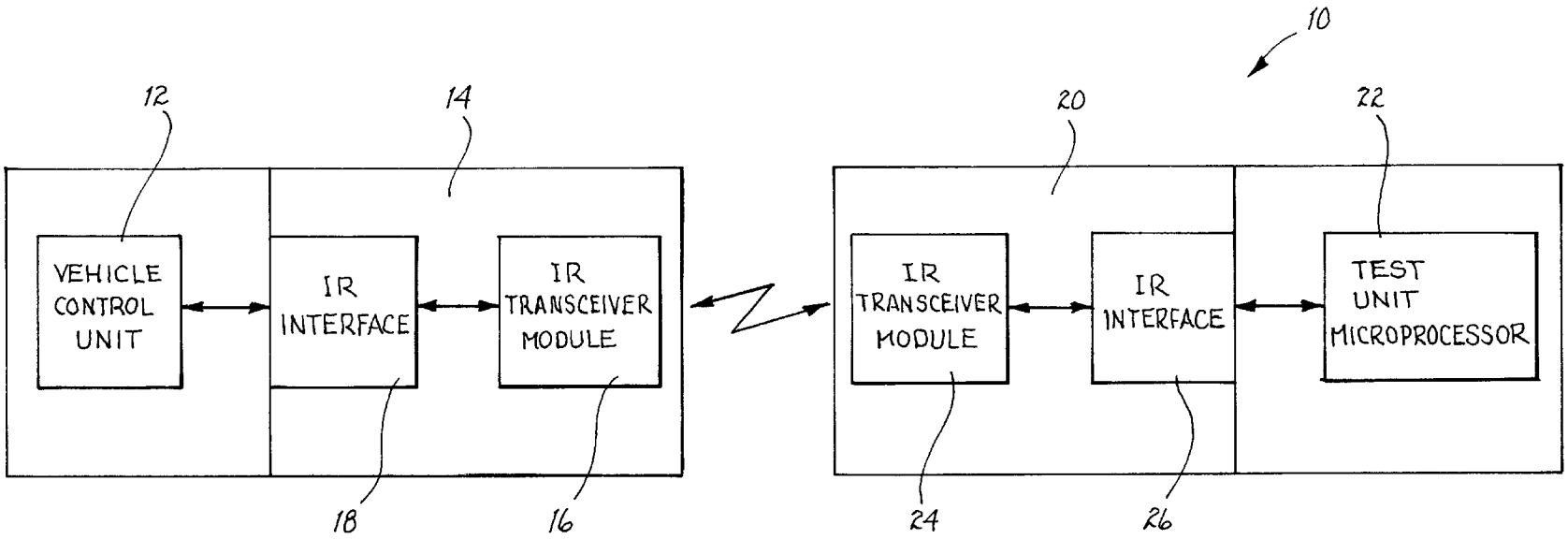
FIG. 1 is a partial exploded view of a mirror device in accordance with the present invention.
Figure 2:
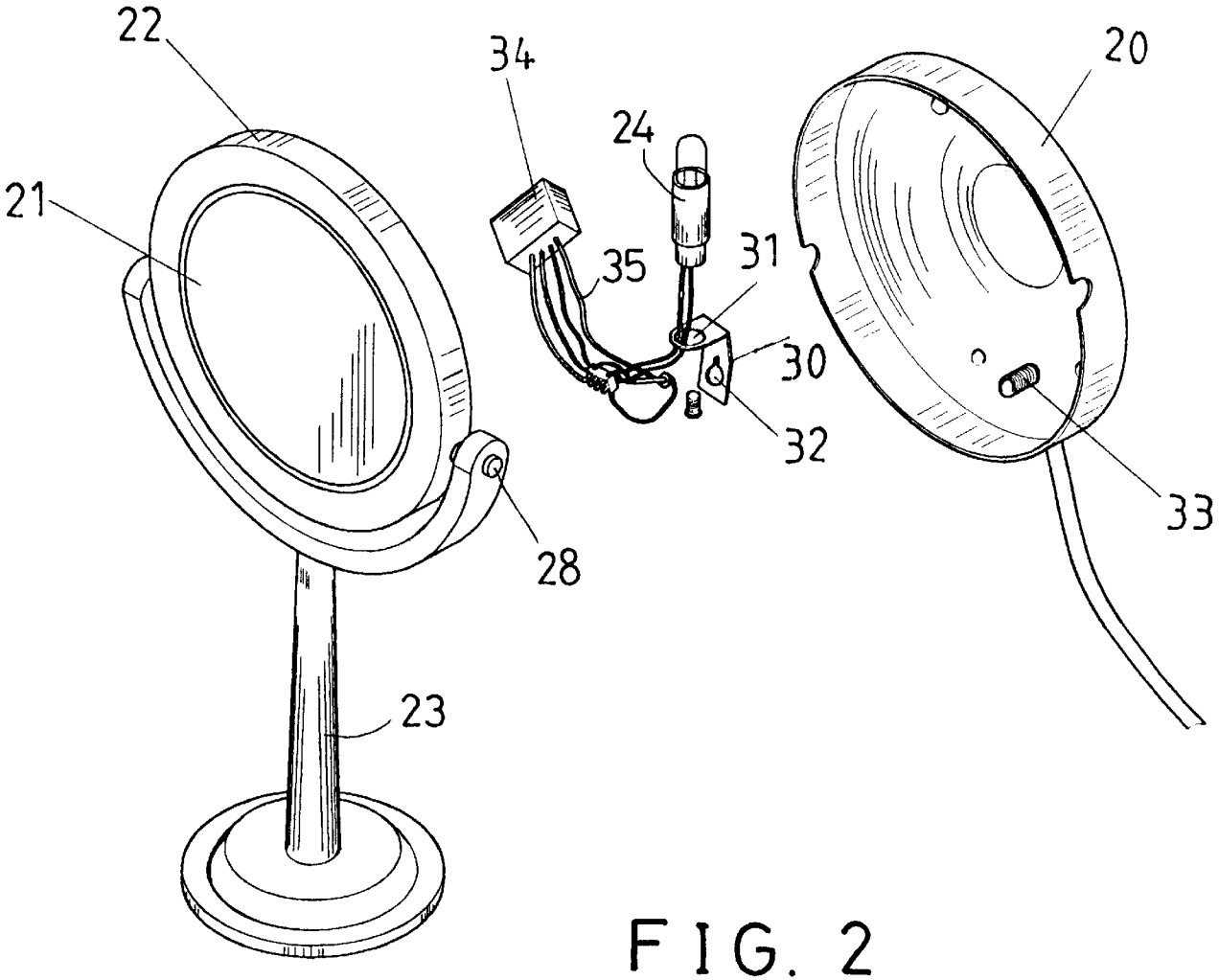
FIG. 2 is an exploded view of the mirror device.

Referring to the drawings, a mirror device in accordance with the present invention comprises a frame 22 for engaging with and for supporting a mirror 21 of plastic, glass or similar material. The frame 22 is pivotally coupled to and supported on a support 23 at a pivot shaft 28. A cover 20 is made of electric conductive material and is secured to the frame 22 and includes a fastener 33, such as a bolt extended therein. A bracket 30 includes a hole 32 engaged with the fastener 33 for allowing the bracket 30 to be secured to the cover 20 and includes another hole 31 for receiving and for attaching a light bulb 24. A contact switch 34 is disposed in the cover 20 and includes an electric wire or a terminal 35 electrically coupled to the fastener 33 and thus the cover 20. The contact switch 34 is not required to be secured to the cover 20, and of course, may be secured to the cover 20 by such as adhesive materials or by fasteners.

In operation, the user may contact with the cover 20 for actuating the contact switch 34 that is electrically coupled to the fastener 33 and the cover 20 by the terminal 35.

Accordingly, the mirror device in accordance with the present invention includes a contact switch disposed therein for lighting purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mirror device comprising:

a frame, a mirror attached to said frame, a cover secured to said frame and made of electric conductive material, a conductive fastener secured to said cover, at least one light bulb, and a contact switch coupled between said at least one light bulb and said conductive fastener for coupling said at least one light bulb to said cover and for allowing said contact switch to be actuated via said cover.

2. The mirror device according to claim 1 further comprising a bracket secured to said cover, said at least one light bulb is secured to said bracket.

* * * * *

UNITED STATES PATENT AND TRADEMARK OFFICE

CERTIFICATE OF CORRECTION

PATENT NO. : 5,930,060
DATED : June 13, 2000
INVENTOR(S) : Wingyu Leung

It is certified that error appears in the above-identified patent and that said Letters Patent is hereby corrected as shown below:

Drawings,
The title page should be deleted and substitute therefore the attached title page.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*

United States Patent [19]

Shih

[11] Patent Number: 5,930,06

[45] Date of Patent: Jul. 27, 199

[54] MIRROR DEVICE HAVING A CONTACT SWITCH

[76] Inventor: Sen Tien Shih, 7F-1, No. 170, Sec. 1, San Min Rd., Taichung, Taiwan

[21] Appl. No.: 09/072,221

[22] Filed: May 4, 1998

[51] Int. Cl.[6] ..... G02B 7/182; F21V 33/00

[52] U.S. Cl. ..... 359/872; 359/881; 362/135; 362/136; 362/142; 362/144

[58] Field of Search ..... 359/839, 871, 359/872, 881; 362/135, 136, 137, 138, 139, 140, 141, 142, 143, 144, 494

[56] References Cited

U.S. PATENT DOCUMENTS

| | | | |
|---|---|---|---|
| 1,315,457 | 9/1919 | Benedict | 362/135 |
| 1,368,340 | 2/1921 | Jarvis | 362/142 |
| 1,689,471 | 10/1928 | Andrusis | 359/839 |
| 1,761,393 | 6/1930 | Hoegger | 362/141 |
| 2,200,114 | 5/1940 | Konikoff | 362/144 |
| 2,267,132 | 12/1941 | Pavenick | 362/14 |
| 3,217,154 | 11/1965 | Owen | 362/13 |
| 3,476,927 | 11/1969 | Rothman | 362/14 |
| 4,507,716 | 3/1985 | Benedict, Jr. . | |
| 4,751,625 | 6/1988 | Lin . | |
| 5,223,814 | 6/1993 | Suman . | |

FOREIGN PATENT DOCUMENTS

| | | | |
|---|---|---|---|
| 551823 | 4/1923 | France | 362/14 |

*Primary Examiner*—Ricky D. Shafer

[57] ABSTRACT

A mirror device includes a mirror attached to a frame which is pivotally coupled to a support at a pivot shaft. A cover is secured to the frame and made of electric conductive material. A conductive fastener is secured to the cover. One or more light bulbs are disposed in the cover and coupled to a contact switch which is coupled to the conductive fastener for coupling the light bulb to the cover and for allowing the contact switch to be actuated via the cover. A bracket is secured to the cover for supporting the light bulbs.

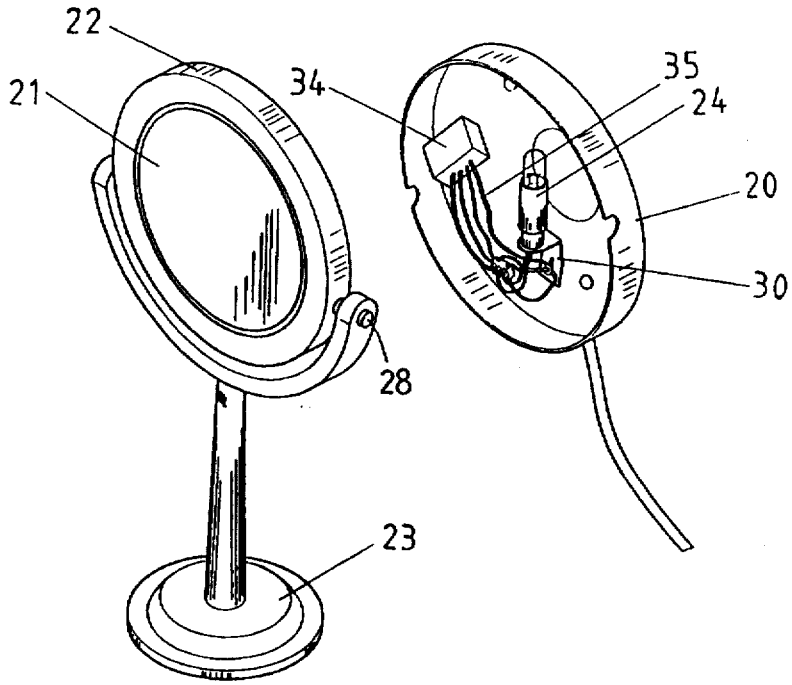

2 Claims, 2 Drawing Sheets